US011105295B2

(12) United States Patent
Hollweck et al.

(10) Patent No.: US 11,105,295 B2
(45) Date of Patent: Aug. 31, 2021

(54) CYLINDER HEAD WITH CONNECTED EXHAUST MANIFOLD OF AN INTERNAL COMBUSTION ENGINE

(71) Applicant: MAN TRUCK & BUS AG, Munich (DE)

(72) Inventors: Johannes Hollweck, Sulzbach-Rosenberg (DE); Ulrich Boehme, Nuremberg (DE); Tobias Arroyo Böttcher, Nuremberg (DE)

(73) Assignee: MAN Truck & Bus AG, Munich (DE)

( * ) Notice: Subject to any disclaimer, the term of this patent is extended or adjusted under 35 U.S.C. 154(b) by 0 days.

(21) Appl. No.: 15/787,349

(22) Filed: Oct. 18, 2017

(65) Prior Publication Data

US 2018/0112623 A1 Apr. 26, 2018

(30) Foreign Application Priority Data

Oct. 25, 2016 (DE) ..... 102016012719.8

(51) Int. Cl.

| | |
|---|---|
| ***F02F 1/42*** | (2006.01) |
| ***F01N 13/10*** | (2010.01) |
| ***F02F 11/00*** | (2006.01) |
| *F02F 1/00* | (2006.01) |

(52) U.S. Cl.

CPC ..... *F02F 1/4264* (2013.01); *F01N 13/102* (2013.01); *F02F 1/4271* (2013.01); *F02F 11/002* (2013.01); *F02F 2001/008* (2013.01)

(58) Field of Classification Search

CPC ..... F01N 13/102; F02F 1/4271; F02F 1/4264

(Continued)

(56) References Cited

U.S. PATENT DOCUMENTS 2,295,436 A 9/1942 Tendler
4,096,690 A * 6/1978 Florek ..... F01N 3/34 60/282

(Continued)

FOREIGN PATENT DOCUMENTS

CN 2260172 Y 8/1997
CN 2260179 Y 8/1997

(Continued)

OTHER PUBLICATIONS

Office Action dated Dec. 21, 2021 issued in Russian Patent Application No. 2017134960/12.

(Continued)

*Primary Examiner* — Lindsay M Low
*Assistant Examiner* — Omar Morales
(74) *Attorney, Agent, or Firm* — Cozen O'Connor

(57) ABSTRACT

A cylinder head with connected exhaust manifold of an internal combustion engine the cylinder head has an exhaust duct ending at a cylinder head connecting face to which the exhaust manifold is connected. A flange bushing insert having a bushing part and an end-side flange, is inserted into an exhaust gas duct of the cylinder head. The bushing part has a radially protruding, circumferential bead as a spacer and sealing element that bears against the exhaust duct inner wall. The flange projects at the end of the flange bushing insert and is clamped between the cylinder head connecting face and the exhaust manifold connecting face such that a circumferential insulating gap.

13 Claims, 1 Drawing Sheet

(58) Field of Classification Search
USPC ..... 123/193.5
See application file for complete search history.

(56) References Cited

U.S. PATENT DOCUMENTS

| | | | | |
|---|---|---|---|---|
| 4,103,487 | A * | 8/1978 | Yamazaki | F02B 77/02 123/193.5 |
| 4,195,478 | A | 4/1980 | Rao et al. | |
| 5,055,435 | A | 10/1991 | Hamanaka et al. | |
| 5,414,993 | A | 5/1995 | Kon | |
| 2013/0220265 | A1* | 8/2013 | Hironaka | F02F 1/4271 123/193.5 |

FOREIGN PATENT DOCUMENTS

| | | | |
|---|---|---|---|
| DE | 2323793 | | 11/1974 |
| DE | 2848110 | | 5/1979 |
| DE | 3018277 | | 12/1980 |
| DE | 3607911 | | 9/1986 |
| DE | 3804796 | | 7/1989 |
| EP | 0437303 | A3 | 7/1991 |
| JP | 52-013016 | | 2/1977 |
| JP | H 06-6878 | U | 1/1994 |
| JP | 2001-323852 | | 11/2001 |
| JP | 2007-247432 | | 4/2009 |
| SU | 827826 | | 5/1981 |

OTHER PUBLICATIONS

Search Report dated Apr. 26, 2017 issued in the German Patent Application No. 102016012719.8.

Office Action dated Nov. 17, 2020 issued in Chinese Patent Application No. 201711008367.8.

* cited by examiner

Fig. 1
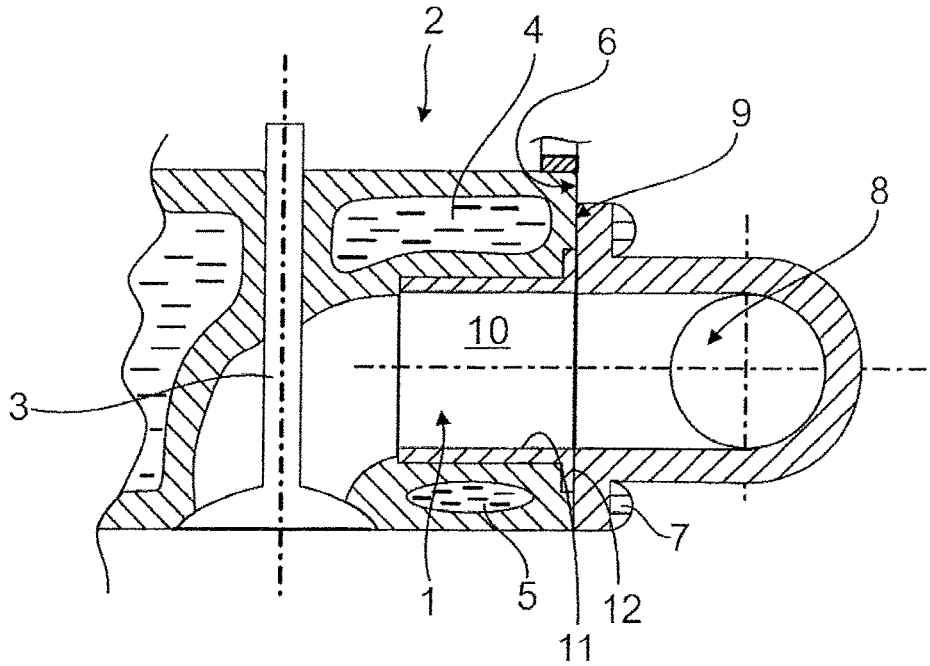
Fig. 2A
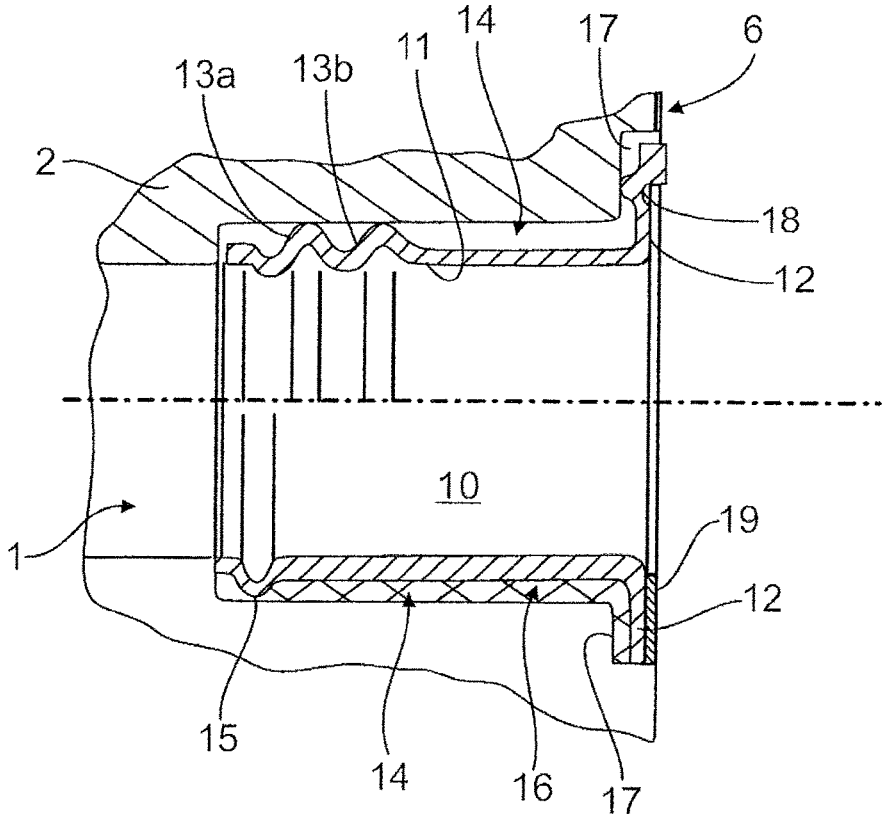
Fig. 2B

CYLINDER HEAD WITH CONNECTED EXHAUST MANIFOLD OF AN INTERNAL COMBUSTION ENGINE

BACKGROUND OF THE INVENTION

1. Field of the Invention

The invention relates to a cylinder head with connected exhaust manifold of an internal combustion engine.

2. Description of the Related Art

In one generally known arrangement, the cylinder head has, after the outlet valve, an exhaust duct that ends on an outer cylinder head connecting face. An exhaust manifold with an assigned exhaust manifold connecting face is connected by a screw joint to this cylinder head connecting face such that the exhaust duct of the cylinder head is continued in the exhaust manifold.

An exhaust manifold seal is fitted between the cylinder head connecting face and the exhaust manifold connecting face for an exhaust gas-impervious connection of the exhaust manifold to the cylinder head. Coolant ducts through which a coolant flows in the cylinder head lie in the region of the exhaust duct. Depending on the number of cylinders of the internal combustion engine and their arrangement, a cylinder head has a plurality of exhaust ducts to which in each case exhaust manifolds of an exhaust gas collector are connected.

In the case of a generic internal combustion engine, the hot exhaust gas is conducted via the exhaust duct into the exhaust manifold, possibly into a turbocharger and then further via silencers into the atmosphere. In the case of a normally fluid-cooled internal combustion engine, a large amount of heat energy is discharged into the cooling medium flowing through the cylinder head. As a result, components close to the exhaust duct can be loaded in a thermally inadmissible manner and possibly damaged. Moreover, as a result, energy is removed from the exhaust gas, which energy could be used by energy conversion, for example, in a downstream exhaust gas turbocharger.

Measures are already known in the prior art by which such thermal loading is reduced. In the case of a first known measure, a thermally insulating coating is applied to the inner wall of the outlet duct (NEMAK GmbH). In the case of a different measure which is also supposed to reduce the thermal load, the exhaust duct in the cylinder head is embodied entirely in ceramic. These are clearly disadvantageously complex, costly solutions. Moreover, separate exhaust manifold seals must also be provided here independently of the desired reduction in thermal loading for the exhaust gas-impervious connection of an exhaust manifold.

SUMMARY OF THE INVENTION

An object of one aspect of the invention is, by a simple, low-cost solution, to reduce the thermal load in the region of an exhaust duct of the cylinder head and also make available a simple, low-cost exhaust manifold seal.

According to one aspect of the invention, a cylinder head with a connected exhaust manifold of an internal combustion engine is provided. The cylinder head has at least one exhaust duct that ends at an outer cylinder head connecting face to which the exhaust manifold, which forms a continuation of the exhaust duct, is connected with an assigned exhaust manifold connecting face, preferably by at least one screw connection. According to one aspect of the invention, a flange bushing insert comprising a bushing part and an end-side flange part is inserted into the exhaust duct of the cylinder head. The bushing part has at least one radially protruding, circumferential bead as a spacer and sealing element with which the bushing part bears against the exhaust duct inner wall. The flange part projects in an annular disc shape radially at the outer end of the flange bushing and is clamped imperviously between the cylinder head connecting face and the exhaust manifold connecting face, and indeed is preferably clamped as a sealing flange, highly preferably clamped as a sealing flange and for axial bushing fixing, in such a manner that a circumferential insulating gap, which is uncoupled from an exhaust gas flow and is thermally insulating with a gap width corresponding to the bead height, is formed between the exhaust duct inner wall and the bushing part outer wall as well as between the flange part and an axially adjacent bead and/or between two beads lying axially next to one another.

The simply formed flange bushing insert, which can be produced at low cost, advantageously has two functions, namely thermal insulation of the exhaust duct as well as sealing of the exhaust manifold. Here, these two functions are integrated in a single component with advantages in terms of production, procurement, logistics and assembly.

With a bushing part length extending over the entire exhaust duct length of the cylinder head, possibly also already with a partial length, a thermal insulation of the exhaust duct in the cylinder head is achieved, with which its thermal loading can be significantly reduced. It is thus achieved that on one hand less heat energy can be discharged via the cooling medium so that the dimensions of a cooling system can be advantageously reduced as a result. On the other hand, as a result of the thermal insulation, more heat energy remains in the exhaust gas, which can be used for increased energy conversion in particular in an exhaust gas turbocharger.

A further advantage lies in the fact that, as a result of the flange part fixed in a sealing manner between the exhaust duct and the exhaust manifold, the bushing part connected thereto is also fixed in an axially non-displaceable and rotationally conjoint manner in the exhaust duct.

Thermal insulation is carried out here substantially by the principle of air gap insulation in the insulating gap.

Instead of air, at least in partial regions of the insulating gap on the bushing part outer wall, a thermal insulating element and/or material, preferably in the insulating gap width, can also alternatively be fitted, in particular as a coating and/or as a pushed-on insulating material bushing and/or as e.g. pushed-on insulating material shell(s).

The flange bushing insert is expediently produced in one piece and/or of uniform material from a heat-resistant and/or elastic material, in particular from a metallic substance.

According to a further particularly preferred configuration, at least one bead can be arranged in the axial bushing part end region opposite the flange part for formation of an insulating gap, which is as axially long as possible.

According to a further particularly preferred configuration, the bushing part length corresponds where possible to the exhaust duct length in the cylinder head.

According to a particularly preferred concrete configuration and in particular for an exact arrangement and/or fixing, the flange part lies in an annular groove of the cylinder head connecting face.

As already mentioned above, the flange part is clamped between the cylinder head connecting face and the exhaust manifold connecting face preferably as a sealing flange or as a sealing flange and for axial bushing fixing. To this end, according to a first embodiment, it can be provided that the flange part is supported axially with at least one circumferential, preferably elastically formed bead on the cylinder head connecting face, preferably in the annular groove of the cylinder head connecting face. Here, the flange part preferably projects axially in the direction of the exhaust manifold or protrudes so that it clamps the flange part as a sealing element during mounting. In an alternative configuration to this, however, a sealing ring which protrudes, in particular projects, in the direction of the exhaust manifold can also be provided on the flange part. A combination of both configurations (bead and sealing ring) is also in principle possible.

Thermal insulation of an exhaust duct with the flange bushing insert according to one aspect of the invention can be used in particular in the case of an internal combustion engine of a vehicle, in particular of a utility vehicle.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

The invention will be explained in greater detail further by way of example on the basis of a schematic drawing.

FIG. 1 is a section through an exhaust duct of a cylinder head with connected exhaust manifold, and FIGS. 2*a* and 2*b* are two exemplary embodiments of a flange bushing insert inserted into an exhaust duct.

DETAILED DESCRIPTION OF THE PRESENTLY PREFERRED EMBODIMENTS

A longitudinal section through an exhaust duct 1 of a cylinder head 2 of an internal combustion engine is represented in FIG. 1. Exhaust duct 1 lies on the outflow side downstream of an outlet valve 3 and is partially surrounded by cooling ducts 4, 5 through which cooling medium flows.

Exhaust duct 1 ends at an outer cylinder head connecting face 6, to which here, by way of example by several screw connections or screw joints 7, an exhaust manifold 8 is connected in an exhaust gas-impervious manner with its assigned exhaust manifold connecting face 9.

A flange bushing insert 10, which is represented in an enlarged form with further details in FIGS. 2*a* and 2*b*, is inserted into exhaust duct 1 in a linear region:

Here, flange bushing insert 10 is constructed from a bushing part 11 and an end-side flange part 12.

In a first embodiment according to FIG. 2*a* (upper region of FIG. 2), bushing part 11 has, opposite flange part 12, two beads 13*a*, 13*b* lying next to one another as spacers and sealing elements with which bushing part 11 bears against the exhaust duct inner wall. As a result, a thermally insulating, circumferential insulating gap 14 is formed as an air gap in accordance with the bead height between flange part 12 and bead 13*b*.

In a second, alternative embodiment according to FIG. 2*b* (lower region of FIG. 2), only one circumferential bead is fitted opposite flange part 12 as a spacer and sealing element and the bushing part has on the outside a thermal insulating element and/or material, here, for example, a coating 16 with thermally insulating material that fills the air gap of the first embodiment according to FIG. 2*a* and is also extended into the region of flange part 12 only by way of example here. Alternatively to the coating, an insulating material bushing that can be pushed on or at least one insulating material shell could also be provided, which is then of substantially the same design as coating 16 in terms of the shown installation state.

By way of example here in the case of the two embodiments according to FIG. 2*a* and FIG. 2*b*, flange part 12 lies in each case in an annular groove 17 of cylinder head connecting face 6. In the first embodiment according to FIG. 2*a*, flange part 12 is supported axially with a circumferential, elastic bead 18 on cylinder head connecting face 6 or in annular groove 17 of cylinder head connecting face 6 and projects axially in the direction of exhaust manifold 8 or protrudes so that it clamps flange part 12 as a sealing element during mounting. In the embodiment according to FIG. 2*b*, a sealing ring 19 protruding in the direction of exhaust manifold 8, possibly with a uniform material to coating 16, is fitted here by way of example on flange part 12. It will be obvious that the sealing solutions (bead 18 and sealing ring 19) on cylinder part 12 can also be used in combination with one another here and can also be swapped, i.e. sealing ring 19 in combination with the configuration in the upper region of FIG. 2*b* and bead solution 18 in combination with the configuration in the lower region of FIG. 2*b*.

With flange bushing insert 10, here, two functions, namely the thermal insulation of exhaust duct 1 with bushing part 11 and sealing of exhaust manifold 8 with flange part 12, are combined in a single component, the production and mounting of which is possible in a very simple manner.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A cylinder head assembly of an internal combustion engine, comprising:

a cylinder head having at least one exhaust duct that ends at an outer cylinder head connecting face;

an exhaust manifold having an assigned exhaust manifold connecting face that is connected to the outer cylinder head connecting face of the cylinder head;

at least one screw connection that connects the cylinder head to the exhaust manifold;

a flange bushing insert inserted into the at least one exhaust duct of the cylinder head, having:

a bushing part that has at least one radially protruding, circumferential bead as a spacer and sealing element with which the bushing part bears against an exhaust duct inner wall; and an end-side flange part that projects in an annular disc shape radially at an outer end of the flange bushing insert and is clamped between the outer cylinder head connecting face and the exhaust manifold connecting face, the flange part being supported axially with at least one circumferential, elastically formed bead, on the outer cylinder head connecting face, the flange part being clamped directly between the outer cylinder head connecting face and the exhaust manifold connecting face without intervening elements as at least one of a sealing flange and for axial bushing fixing, wherein the flange part projects axially in a direction of the exhaust manifold so that it clamps the flange part as a sealing element during mounting; and a circumferential thermally insulating gap that is uncoupled from an exhaust gas flow having a gap width corresponding to a bead height of the circumferential bead bounded by the exhaust duct inner wall, an outer wall of the bushing part, the flange part, and the at least one radially protruding, circumferential bead.

2. The cylinder head assembly according to claim 1, wherein the flange bushing insert is produced at least one of:

in one piece;

of uniform material;

from a heat-resistant material;

from an elastic material; and from a metallic substance.

3. The cylinder head assembly according to claim 1, wherein at least one of a thermal insulating element and a thermal insulating material is fitted at least in partial regions of the circumferential thermally insulating gap on the outer wall of the bushing part.

4. The cylinder head assembly according to claim 3, wherein the at least one of a thermal insulating element and a thermal insulating material is formed by at least one of a coating, an insulating material bushing, and at least one insulating material shell.

5. The cylinder head assembly according to claim 3, wherein the at least one of a thermal insulating element and a thermal insulating material is pushed on the bushing part.

6. The cylinder head assembly according to claim 1, wherein at least one bead is arranged in an axial bushing part end region of the bushing part opposite the flange part.

7. The cylinder head assembly according to claim 1, wherein a length of the bushing part substantially corresponds to a length of the at least one exhaust duct in the cylinder head.

8. The cylinder head assembly according to claim 1, wherein the flange part lies in an annular groove of the outer cylinder head connecting face.

9. The cylinder head assembly according to claim 8, wherein the flange part is supported axially with at least one circumferential, elastically formed bead in the annular groove of the outer cylinder head connecting face.

10. The cylinder head assembly according to claim 1, wherein a sealing ring that protrudes in a direction of the exhaust manifold is provided on the flange part.

11. The cylinder head assembly according to claim 1, wherein the at least one of a thermal insulating element and a thermal insulating material is fitted in the insulating gap width.

12. The cylinder head assembly according to claim 1, wherein a first face portion of the flange part is in direct contact with the outer cylinder head connecting face and a second face portion of the flange part, which is axially opposite the first face portion, is in direct contact with the exhaust manifold connecting face.

13. A vehicle, comprising:

an internal combustion engine having:

a cylinder head assembly, comprising:

a cylinder head having at least one exhaust duct that ends at an outer cylinder head connecting face;

an exhaust manifold having an assigned exhaust manifold connecting face that is connected to the outer cylinder head connecting face of the cylinder head;

at least one screw connection that connects the cylinder head to the exhaust manifold;

a flange bushing insert inserted into the at least one exhaust duct of the cylinder head, having:

a bushing part that has at least one radially protruding, circumferential bead as a spacer and sealing element with which the bushing part bears against an exhaust duct inner wall; and an end-side flange part that projects in an annular disc shape radially at an outer end of the flange bushing insert and is clamped directly between the outer cylinder head connecting face and the exhaust manifold connecting face without intervening elements, the flange part being supported axially with at least one circumferential, elastically formed bead, on the outer cylinder head connecting face, the flange part is clamped between the outer cylinder head connecting face and the exhaust manifold connecting face as at least one of a sealing flange and for axial bushing fixing, wherein the flange part projects axially in a direction of the exhaust manifold so that it clamps the flange part as a sealing element during mounting; and a circumferential thermally insulating gap that is uncoupled from an exhaust gas flow having a gap width corresponding to a bead height of the circumferential bead bounded by the exhaust duct inner wall, an outer wall of the bushing part, the flange part, and the at least one radially protruding, circumferential bead.

* * * * *